US011598190B2

(12) United States Patent
Sharp et al.

(10) Patent No.: US 11,598,190 B2
(45) Date of Patent: Mar. 7, 2023

(54) DUAL PUMP INTEGRATED FRACKING SYSTEM

(71) Applicant: STEWART & STEVENSON LLC, Houston, TX (US)

(72) Inventors: Brian Sharp, Houston, TX (US); Chad Joost, Houston, TX (US); Chris Harvell, Houston, TX (US); Paul Smith, Houston, TX (US); Filiberto Garcia, Houston, TX (US); Adam Lambertus, Houston, TX (US); Jeff Smith, Houston, TX (US)

(73) Assignee: STEWART & STEVENSON LLC, Houston, TX (US)

( * ) Notice: Subject to any disclaimer, the term of this patent is extended or adjusted under 35 U.S.C. 154(b) by 0 days.

(21) Appl. No.: 17/334,508

(22) Filed: May 28, 2021

(65) Prior Publication Data

US 2022/0364451 A1 Nov. 17, 2022

Related U.S. Application Data

(63) Continuation-in-part of application No. 16/885,940, filed on May 28, 2020.

(60) Provisional application No. 62/855,634, filed on May 31, 2019, provisional application No. 63/188,818, filed on May 14, 2021.

(51) Int. Cl.

| | |
|---|---|
| ***E21B 43/26*** | (2006.01) |
| ***F04B 17/03*** | (2006.01) |
| ***F04B 17/06*** | (2006.01) |
| ***F04B 15/02*** | (2006.01) |

(52) U.S. Cl.

CPC ..... *E21B 43/2607* (2020.05); *F04B 15/02* (2013.01); *F04B 17/03* (2013.01); *F04B 17/06* (2013.01)

(58) Field of Classification Search

CPC ..... E21B 43/2607; F04B 15/02; F04B 17/03; F04B 17/06

See application file for complete search history.

(56) References Cited

U.S. PATENT DOCUMENTS

| | | | | |
|---|---|---|---|---|
| 7,552,903 | B2 * | 6/2009 | Dunn | B63H 21/16 248/637 |
| 2019/0154020 | A1 * | 5/2019 | Glass | F04B 15/02 |
| 2020/0109616 | A1 * | 4/2020 | Oehring | B01D 39/14 |
| 2020/0109617 | A1 * | 4/2020 | Oehring | F02B 63/06 |
| 2020/0263528 | A1 * | 8/2020 | Fischer | E21B 43/2605 |
| 2020/0378232 | A1 * | 12/2020 | Sharp | E21B 43/2607 |
| 2021/0131411 | A1 * | 5/2021 | Oehring | F04B 17/03 |

* cited by examiner

*Primary Examiner* — Charles G Freay
(74) *Attorney, Agent, or Firm* — Ewing & Jones, PLLC

(57) ABSTRACT

An integrated fracking system may include a substructure assembly including one or more frame rails. The integrated fracking system may include a variable frequency drive (VFD) coupled to the frame rails of the substructure assembly. The integrated fracking system may include a transformer coupled to the frame rails of the substructure assembly. The integrated fracking system may include a pump subsystem. The pump subsystem may include a first frac pump, a first motor operatively coupled to the first frac pump, a second frac pump, and a second motor operatively coupled to the second frac pump. The pump subsystem may be coupled to the frame rails of the substructure assembly.

22 Claims, 6 Drawing Sheets

DUAL PUMP INTEGRATED FRACKING SYSTEM

CROSS REFERENCE TO RELATED APPLICATIONS

This application is a nonprovisional application which claims priority from U.S. provisional application No. 63/188,818, filed May 14, 2021, is a continuation in part of U.S. nonprovisional application Ser. No. 16/885,940, filed May 28, 2020, which claims priority from U.S. provisional application No. 62/855,634, filed May 31, 2019.

TECHNICAL FIELD/FIELD OF THE DISCLOSURE

The present disclosure relates to wellsite equipment, specifically to wellsite equipment used for hydraulic fracturing.

BACKGROUND OF THE DISCLOSURE

Hydraulic fracturing, referred to herein as fracking, is a method used to enhance hydrocarbon recovery from certain downhole formations. Fracking involves the injection of high-pressure fluid into the downhole formation to induce fracturing of the formation. A proppant is typically included in the fluid used for fracturing. The proppant enters the fractures and retards the closure of the fractures once the fracking operation is completed. The fractures produced may provide additional flow channels for hydrocarbons to escape the formation.

Multiple pieces of wellsite equipment are used during a fracking operation including pumps used to supply the fracturing fluid to the formation, referred to herein as frac pumps. Frac pumps are typically driven by diesel motors. Frac pumps require the use of multiple other pieces of wellsite equipment to function, each of which must be operatively coupled in order to undertake a fracking operation.

SUMMARY

The present disclosure provides for an integrated fracking system. The integrated fracking system may include a substructure assembly including one or more frame rails. The integrated fracking system may include a pump subsystem. The pump subsystem may include a first frac pump, a first motor operatively coupled to the first frac pump, a second frac pump, and a second motor operatively coupled to the second frac pump. The pump subsystem may be coupled to the frame rails of the substructure assembly. The integrated fracking system may include a variable frequency drive (VFD) coupled to the frame rails of the substructure assembly. The integrated fracking system may include a transformer coupled to the frame rails of the substructure assembly.

BRIEF DESCRIPTION OF THE DRAWINGS

The present disclosure is best understood from the following detailed description when read with the accompanying figures. It is emphasized that, in accordance with the standard practice in the industry, various features are not drawn to scale. In fact, the dimensions of the various features may be arbitrarily increased or reduced for clarity of discussion.

DETAILED DESCRIPTION

Figure 1:
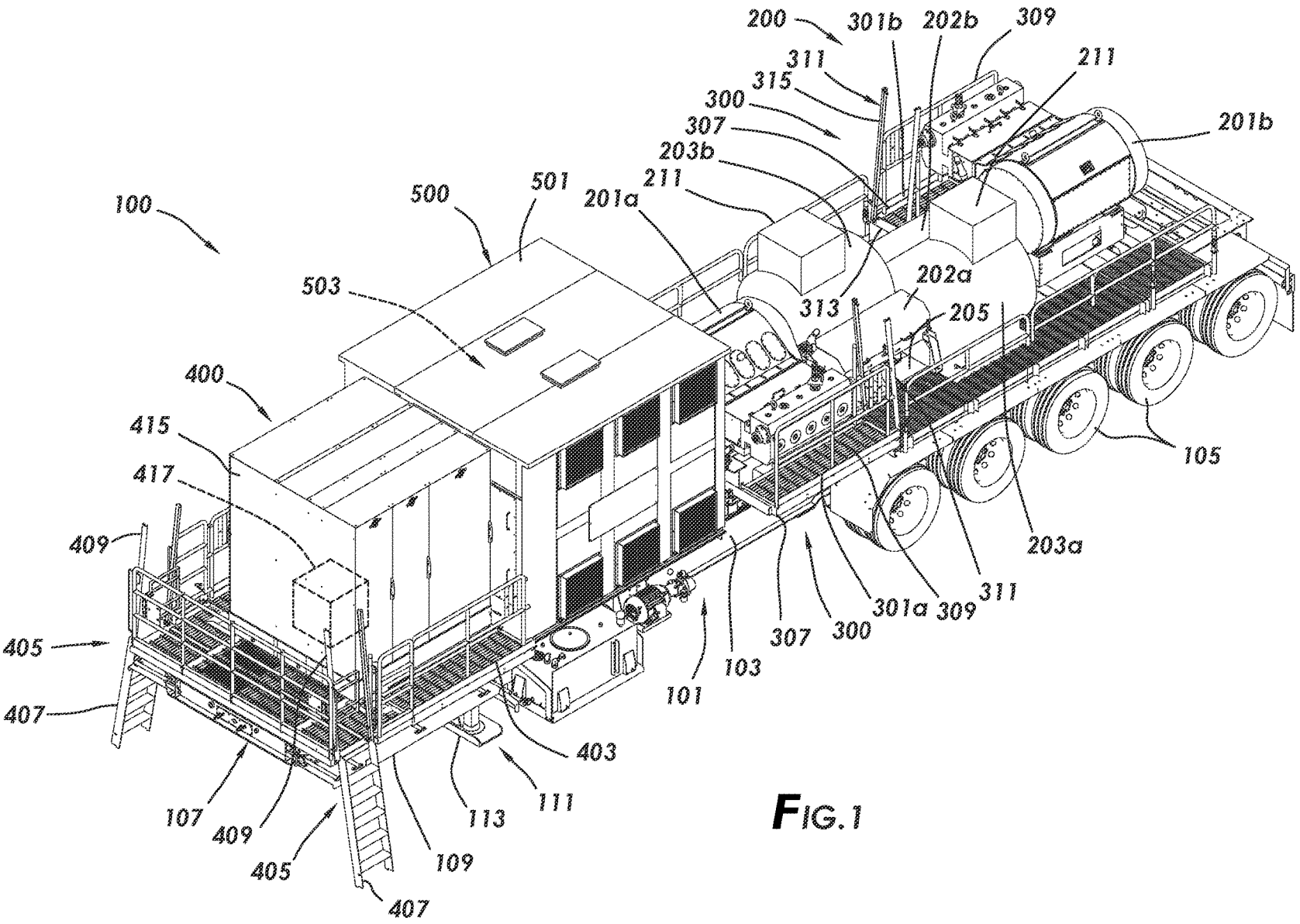
FIG. 1 depicts a perspective view of an integrated fracking system consistent with at least one embodiment of the present disclosure.
Figure 2:
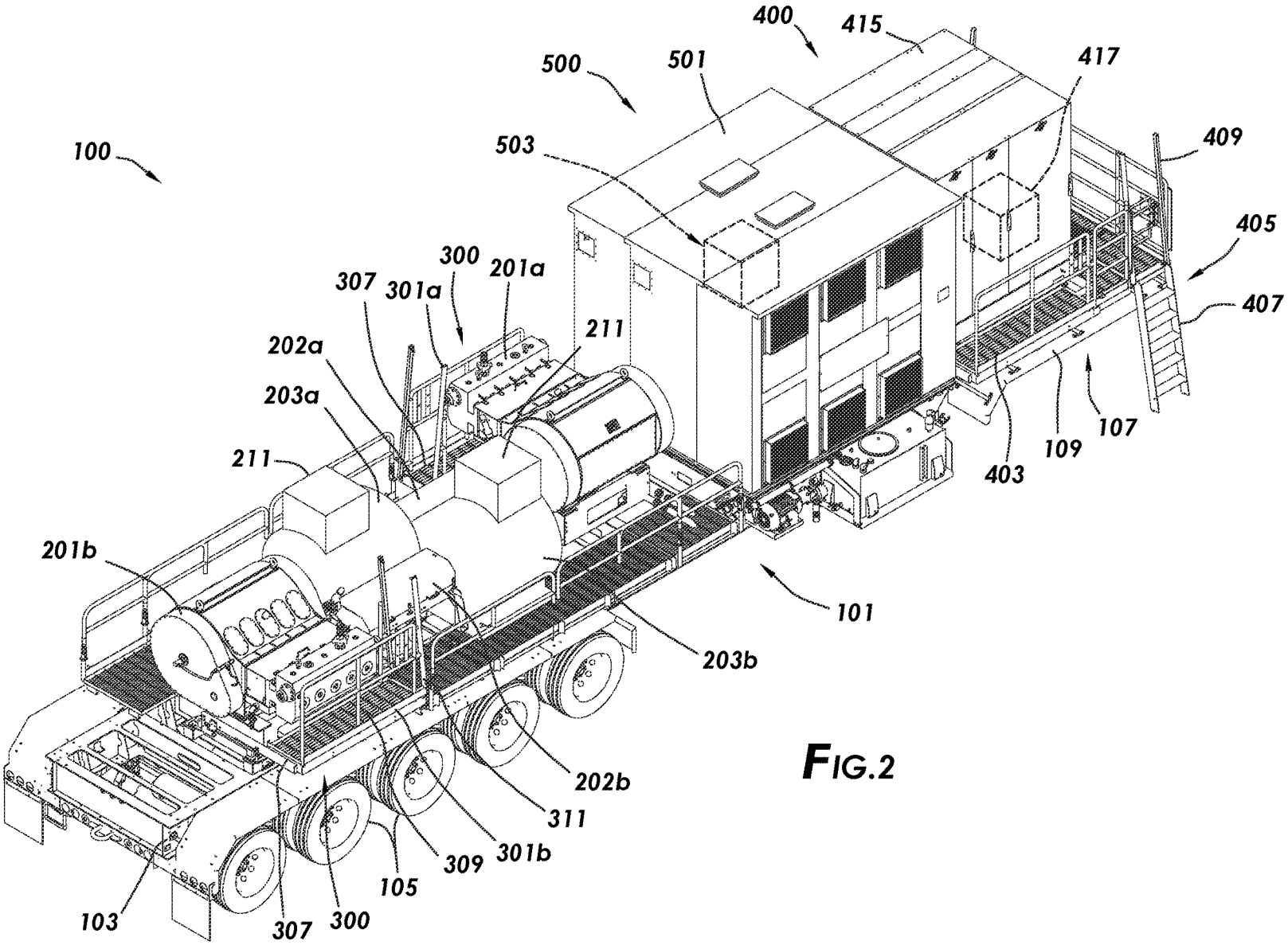
FIG. 2 depicts a perspective view of the integrated fracking system of FIG. 1.
Figure 3:
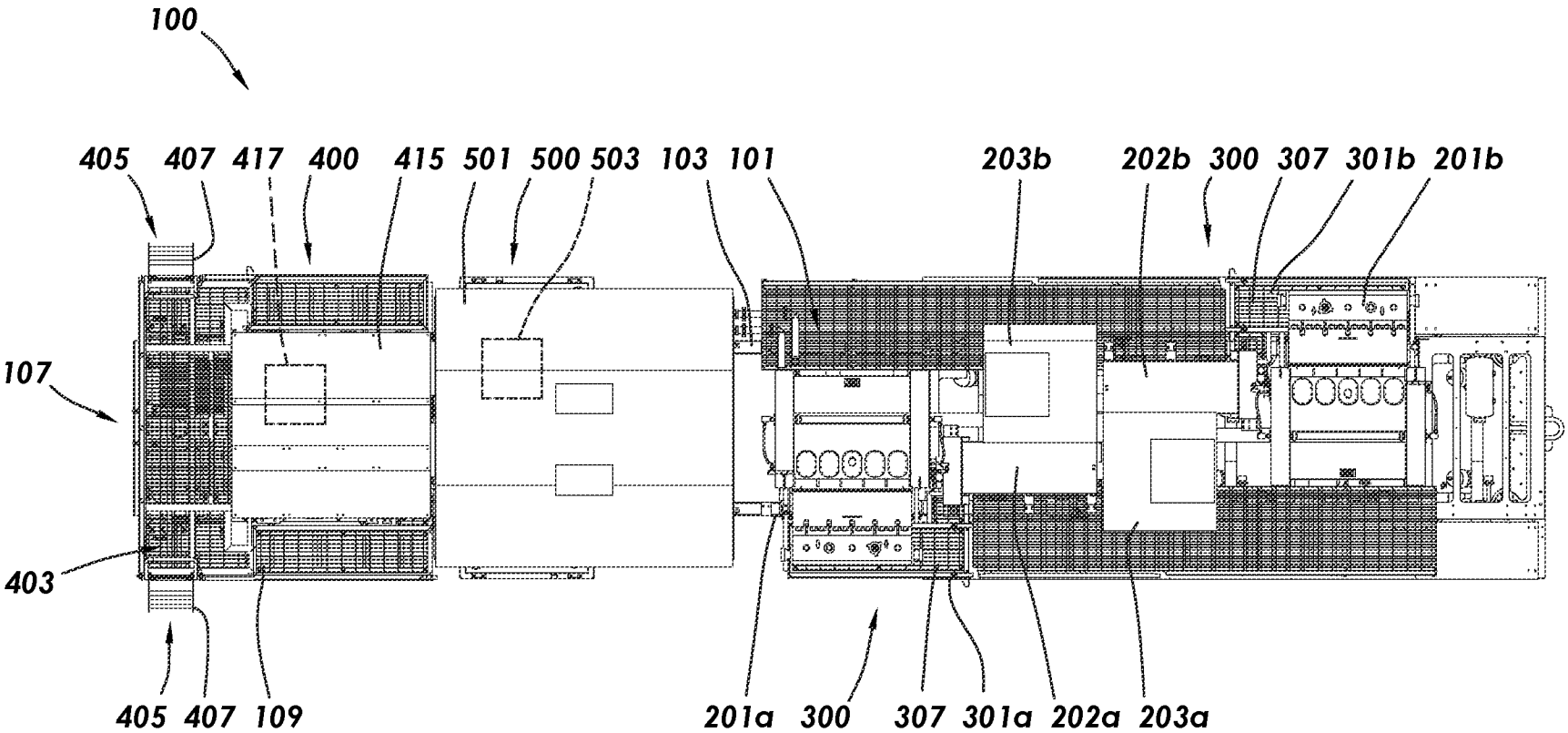
FIG. 3 depicts a top view of the integrated fracking system of FIG. 1.
Figure 4:
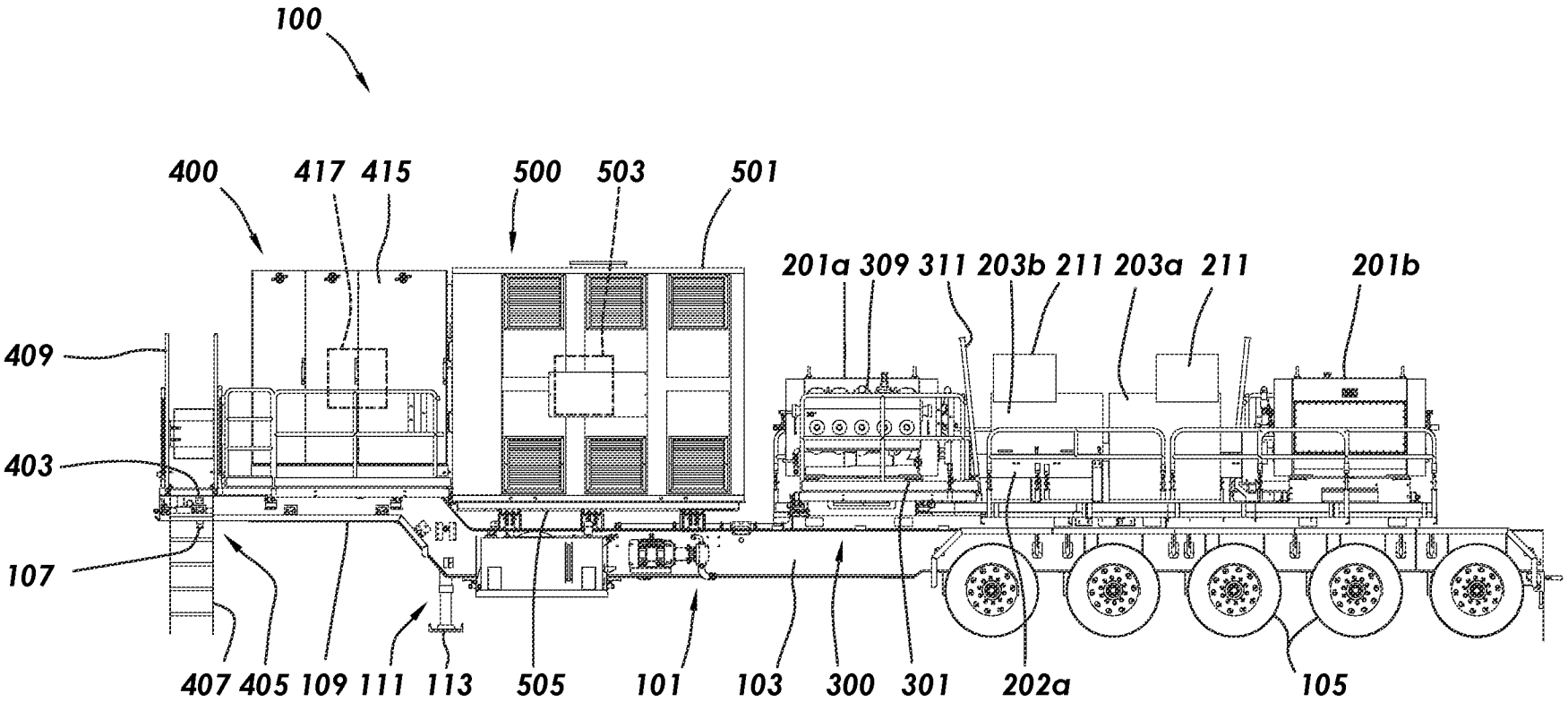
FIG. 4 depicts a side elevation view of the integrated fracking system of FIG. 1.

It is to be understood that the following disclosure provides many different embodiments, or examples, for implementing different features of various embodiments. Specific examples of components and arrangements are described below to simplify the present disclosure. These are, of course, merely examples and are not intended to be limiting. In addition, the present disclosure may repeat reference numerals and/or letters in the various examples. This repetition is for the purpose of simplicity and clarity and does not in itself dictate a relationship between the various embodiments and/or configurations discussed.

FIGS. 1-5 depict integrated fracking system 100. Integrated fracking system 100 may be transportable as a single unit. In some embodiments, integrated fracking system 100 may be configured to be road-transportable as a trailer, truck, or part of a trailer or truck. In other embodiments, integrated fracking system 100 may be configured as a skid. In the embodiments shown in FIGS. 1-5, integrated fracking system 100 is configured as a trailer.

In some embodiments, integrated fracking system 100 may include multiple subsystems including, for example and without limitation, pump subsystem 200, slide-out platform subsystem 300, variable frequency drive (VFD) subsystem 400, and transformer subsystem 500, each of which is further discussed herein below. In some embodiments, each such subsystem may be transported together. In some embodiments, integrated fracking system 100 may be configured such that the subsystems thereof remain operatively connected.

In some embodiments, integrated fracking system 100 may include substructure assembly 101. In some embodiments, substructure assembly 101 may be part of a truck or may make up at least part of a trailer. Substructure assembly 101 may provide support for each subsystem of integrated fracking system 100, as each such subsystem may couple to substructure assembly 101. Substructure assembly 101 may include one or more frame rails 103 positioned to support the subsystems of integrated fracking system 100. Substructure assembly 101 may further include wheels 105 for use in transporting integrated fracking system 100. Substructure assembly 101 may include coupler 107 where substructure assembly 101 is part of a trailer. Coupler 107 may be used, for example, to couple integrated fracking system 100 to a truck for transportation of integrated fracking system 100. In some embodiments, substructure assembly 101 may include gooseneck 109. Gooseneck 109 may assist with the transportability of integrated fracking system 100 when integrated fracking system 100 is coupled to a truck.

In some embodiments, substructure assembly 101 may include leveling system 111. Leveling system 111 may include one or more legs 113 coupled to substructure assembly 101 and positioned to extend from substructure assembly 101 to the ground once integrated fracking system 100 is transported to the desired location. In some embodiments, legs 113 may be extended or retracted such that substructure assembly 101 and the subsystems of integrated fracking system 100 are level during operation thereof. In some embodiments, legs 113 may be retractable such that legs 113 do not interfere with the transportation of integrated fracking system 100.

In some embodiments, substructure assembly 101 may include a cable tray 121. The cable tray 121 may be positioned between and coupled to frame rails 103 of substructure assembly 101 and may extend from the front of substructure assembly 101 at gooseneck 109 to the rear end of substructure assembly 101. In some embodiments, the cable tray 121 may extend beneath the subsystems of integrated fracking system 100 and may be used to house one or more cables and lines including, for example and without limitation, electrical power cables, data or communication cables, hydraulic lines, pneumatic lines, or any other cable or line used in integrated fracking system 100. In some embodiments, the cables and lines within the cable tray 121 may remain operatively coupled to the subsystems of integrated fracking system 100 during transportation such that the need to reconnect each cable or line each time integrated fracking system 100 is to be put into use is reduced.

In some embodiments, the cable tray 121 may include a main power line positioned to receive electrical power from an external power supply with a single connection to integrated fracking system 100. In some embodiments, the primary input cable 122 may include a connection at one or both ends of the cable tray 121 such that electrical power may be provided to integrated fracking system 100 from either the front or rear end of integrated fracking system 100. In some embodiments, power supply may be coupled to the primary input cable 122 of integrated fracking system 100 at a location spaced apart from a hazardous piece of equipment depending on the mode of operation of integrated fracking system 100. In some embodiments, the primary input cable 122 may extend to transformer subsystem 500 as further described herein below.

In some embodiments, substructure assembly 101 may include additional cable trays. For example and without limitation, substructure assembly 101 may include a cable tray that extends between VFD subsystem 400 and pump subsystem 200 and may support one or more electric cables including power supply cables and communications cables that extend between VFD subsystem 400 and pump subsystem 200. Such a cable tray may allow for the electrical connections between VFD subsystem 400 and pump subsystem 200 to remain in operative communication during transportation of integrated fracking system 100.

Integrated fracking system 100 may include pump subsystem 200. In some embodiments, pump subsystem 200 may be located at a rear location of integrated fracking system 100. In some embodiments, pump subsystem 200 may include frac pumps 201*a*, 201*b* and motors 203*a*, 203*b*. Motors 203*a*, 203*b* may be electrically powered. Pump subsystem 200 may be coupled to frame rails 103. Frac pump 201*a* may be operatively coupled to motor 203*a* and frac pump 201*b* may be operatively coupled to motor 203*b*.

In some embodiments, frac pump 201*a* and motor 203*a* and frac pump 201*b* and motor 203*b* may be operated independently. The inclusion of multiple frac pumps 201*a*, 201*b* and respective motors 203*a*, 203*b* may, for example and without limitation, provide redundancy for operations and may provide dual pumping capability from a single integrated fracking system 100.

In some embodiments, frac pumps 201*a*, 201*b* and motors 203*a*, 203*b* may be coupled to frac pump skid 205. Frac pump skid 205 may be selectively decoupleable from substructure assembly 101 of integrated fracking system 100 such that frac pumps 201*a*, 201*b* and motors 203*a*, 203*b* may be assembled apart from substructure assembly 101. Such an arrangement may, for example and without limitation, allow for frac pump skid 205 to be specifically configured for the specific configuration of frac pumps 201*a*, 201*b* and motors 203*a*, 203*b*, thereby making the process of mounting and aligning frac pumps 201*a*, 201*b* and the respective motors 203*a*, 203*b* simpler than an arrangement in which such mounting and alignment were done to substructure assembly 101 directly. Additionally, in some embodiments, the use of such a frac pump skid 205 separate from substructure assembly 101 may allow frac pumps 201*a*, 201*b* and motors 203*a*, 203*b* having different configurations to be used with integrated fracking system 100 by using different frac pump skids 205. In some embodiments, each such frac pump skid 205 may be adapted to be received by substructure assembly 101 of integrated fracking system 100. Additionally, by coupling frac pumps 201*a*, 201*b* and motors 203*a*, 203*b* to frame rails 103 of substructure assembly 101 with frac pump skid 205, frac pumps 201*a*, 201*b* and motors 203*a*, 203*b* may be removed and replaced with a replacement pump subsystem 200 in the case of failure of any of frac pumps 201*a*, 201*b* or motors 203*a*, 203*b*.

In some embodiments, frac pumps 201*a*, 201*b* and motors 203*a*, 203*b*, may be positioned off the centerline of substructure assembly 101. In some such embodiments, frac pump 201*a* and motor 203*a* may be offset in a first lateral direction and frac pump 201*b* and motor 203*b* may be offset in a second lateral direction. In such an arrangement, frac pump 201*a* and motor 203*a* may be positioned at least partially alongside frac pump 201*b* and motor 203*b*. In such an arrangement, the overall length of pump subsystem 200 may be reduced as compared to an arrangement in which frac pump 201*a* and motor 203*a* are positioned directly inline with frac pump 201*b* and motor 203*b*.

In some embodiments, frac pump 201*a* and motor 203*a* may be arranged in the opposite direction as frac pump 201*b* and motor 203*b*. For example, in some embodiments, frac pump 201*a* and motor 203*a* may be arranged such that frac pump 201*a* is in front of motor 203*a*, while frac pump 201*b* and motor 203*b* are arranged such that frac pump 201*b* is behind motor 203*b*. In some embodiments, one or more components of frac pump 201*a* and motor 203*a* may be at least partially longitudinally aligned with one or more components of frac pump 201*b* and motor 203*b*. In some such embodiments, where motors 203*a*, 203*b* are less wide than frac pumps 201*a*, 201*b*, motor 203*a* may be positioned at least partially abeam of motor 203*b*, such that the width of pump subsystem 200 may be reduced as compared to an arrangement in which frac pumps 201*a*, 201*b* and motors 203*a*, 203*b* are positioned entirely abeam.

In some embodiments, frac pump 201*a* may be operatively coupled to motor 203*a* by shaft assembly 202*a* and frac pump 201*b* may be operatively coupled to motor 203*b* by shaft assembly 202*b*. In some embodiments, shaft assemblies 202*a*, 202*b* may be narrower than frac pumps 201*a*, 201*b* and motors 203*a*, 203*b*. In some such embodiments, frac pumps 201*a*, 201*b*, shaft assemblies 202*a*, 202*b*, and motors 203*a*, 203*b* may be arranged such that shaft assembly 202*a* is aligned with motor 203*b* and shaft assembly 202*b* is aligned with motor 203*a*. In such an arrangement, the overall width of pump subsystem 200 may be reduced as compared to an arrangement in which frac pumps 201*a*, 201*b* or motors 203*a*, 203*b* are positioned directly abreast.

In some embodiments, pump subsystem 200 may include motor cooling system 211. Motor cooling system 211 may include, for example and without limitation, one or more electrically driven fans positioned on each of motors 203*a*, 203*b*.

Figure 5:
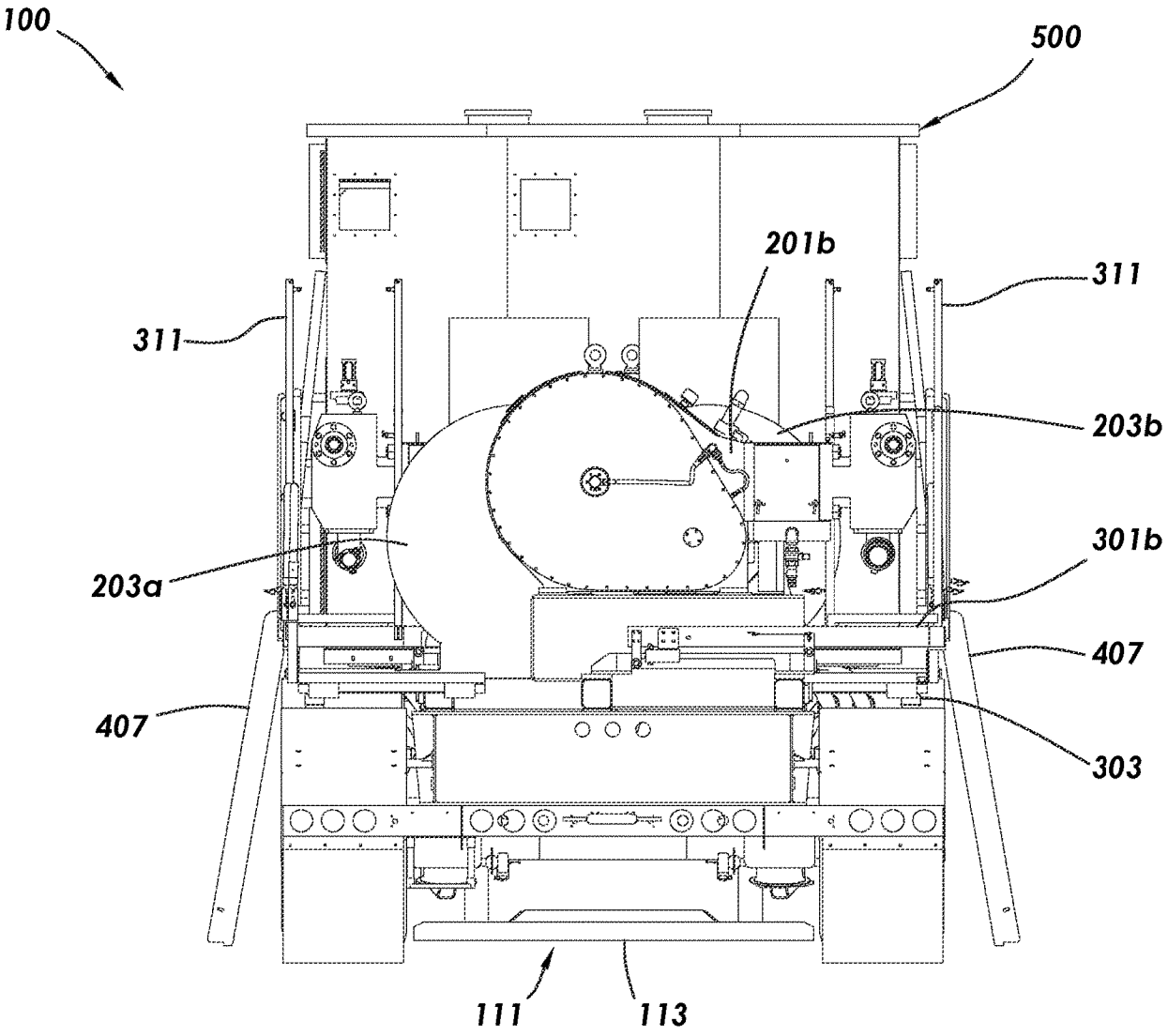
FIG. 5 depicts a rear end elevation view of the integrated fracking system of FIG. 1.
Figure 6:
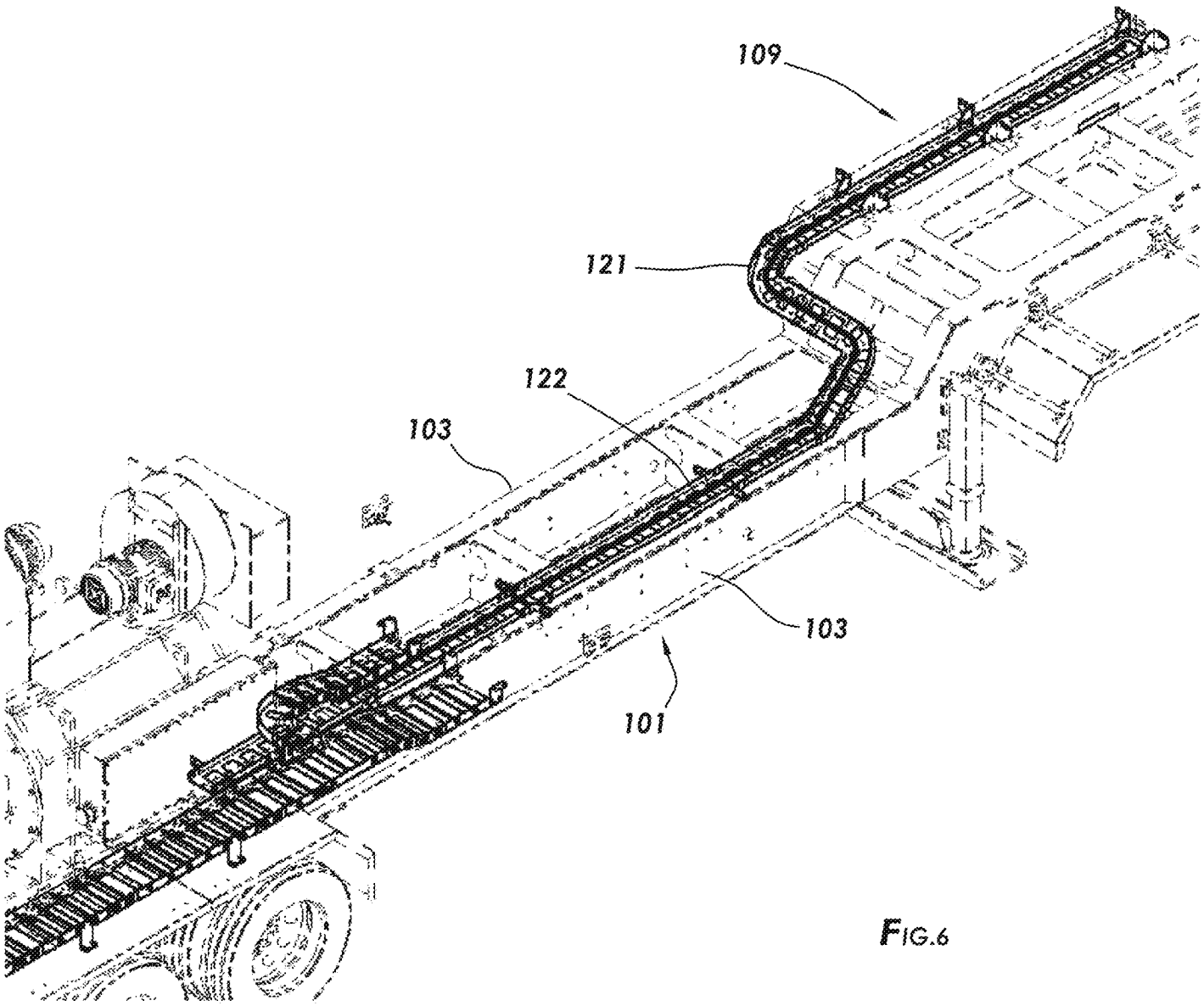
FIG. 6 depicts a cable tray consistent with certain embodiments of the integrated fracking system.

In some embodiments, integrated fracking system 100 may include slide-out platform subsystem 300. Slide-out platform subsystem 300 may, in some embodiments, be located adjacent to pump subsystem 200. In such embodiments, slide-out platform subsystem 300 may include movable platforms 301*a*, 301*b*, shown in the retracted position in FIGS. 1-5. Movable platforms 301*a*, 301*b* may be slidably coupled to frame rails 103 of substructure assembly 101 by one or more slide rails 303 as shown in FIG. 5. In some embodiments, movable platforms 301*a*, 301*b* may move between a retracted position and an extended position manually. In some embodiments, movable platforms 301*a*, 301*b* may move between a retracted position and an extended position by one or more actuators. In some embodiments, the actuators may be electrically powered. The actuators may include, for example and without limitation, a screw drive, a chain drive, a worm drive, or a linear actuator. Movable platforms 301*a*, 301*b* may each include floor 307. In some embodiments floor 307 may be formed as a grated floor.

In some embodiments, movable platforms 301*a*, 301*b* may each include safety railings 309. In some embodiments, movable platforms 301*a*, 301*b* may each include ladder assembly 311. Ladder assembly 311 may include ladder 313 and handrails 315. Handrails 315 may be rigidly coupled to and may extend upward from floor 307. In some embodiments, ladder 313 may be pivotably coupled to floor 307 such that ladder 313 may pivot between a raised position and a lowered position. In other embodiments, ladder 313 may be slidingly coupled to handrails 315 such that ladder 313 may slide between the raised and lowered positions. When in the raised position, ladder 313 may be located within the perimeter of floor 307 such that movable platforms 301*a*, 301*b* may be positioned in the retracted position. When in the lowered position, ladder 313 may extend from floor 307 to the ground such that floor 307 of movable platforms 301*a*, 301*b* may be accessible via ladder 313. In some embodiments, ladder 313 may extend between floor 307 and the ground. In some embodiments, ladder 313 may extend vertically or may extend at an angle to the vertical, such as at an angle between 0° and 60°, 5° and 45°, or 5° and 25° to the vertical. In such an embodiment, use of ladder 313 positioned at an angle to the vertical may be simplified as compared to a vertical ladder.

In some embodiments, ladder 313 may be positioned within handrails 315 when ladder 313 is in the raised position. In some embodiments, one or more retaining mechanisms may be positioned in ladder 313 or handrails 315 which may be used to retain ladder 313 in the raised position. For example, in some embodiments, the retaining mechanism may include a shaft, such as for example, a bolt adapted to pass through a hole formed in each of ladder 313 and handrails 315 such that ladder 313 remains in the raised position when the retaining mechanism is positioned therein. In some embodiments, a securing device such as a cotter pin or nut may be used to retain the retaining mechanism in the locked position.

In some embodiments, movable platforms 301*a*, 301*b* may each include a safety gate. The safety gate may be positioned to extend across the opening between handrails 315. The safety gate may be pivotably coupled to handrails 315 or safety railings 309 such that the safety gate pivots only inwardly, thereby preventing or reducing the chances that a user will inadvertently step off of floor 307 in the direction of ladder assembly 311.

When in the retracted position, movable platforms 301*a*, 301*b* may, in some embodiments, remain within the outer perimeter of substructure assembly 101 to facilitate transportation of integrated fracking system 100. Movable platforms 301*a*, 301*b* may be extended such that equipment of integrated fracking system 100 may be more easily accessible. For example and without limitation, where movable platform 301 is located adjacent pump subsystem 200, access to frac pump 201*a* or 201*b* may be facilitated by the extension of the respective movable platform 301*a* or 301*b*. Ladder 313 may be lowered to the ground, allowing a user to access floor 307 of movable platform 301*a* or 301*b* and thereby access the respective frac pump 201*a* or 201*b* and motor 203*a* or 203*b*.

In some embodiments, with reference to FIG. 1, integrated fracking system 100 may include VFD subsystem 400. VFD subsystem 400 may be mechanically coupled to substructure assembly 101, such as to frame rails 103.

VFD subsystem 400 may include VFD platform 403, accessible from the ground by one or more ladder assemblies 405. Each ladder assembly 405 may include ladder 407 and handrails 409. Handrails 409 may be rigidly coupled to and may extend upward from VFD platform 403. In some embodiments, ladder 407 may be pivotably coupled to VFD platform 403 such that ladder 407 may pivot between a raised position and a lowered position. In other embodiments, ladder 407 may be slidingly coupled to handrails 409 such that ladder 407 may slide between the raised and lowered positions. When in the raised position, ladder 407 may be located within the perimeter of VFD platform 403. In some embodiments, ladder 407 may be positioned within handrails 409 when ladder 407 is in the raised position. When in the lowered position, ladder 407 may extend from VFD platform 403 to the ground such that VFD platform 403 may be accessible via ladder 407. In some embodiments, ladder 407 may extend to the ground at an angle from VFD platform 403, In such an embodiment, use of ladder 407 may be simplified as compared to a vertical ladder.

In some embodiments, VFD subsystem 400 may include VFD enclosure 415, which may protect VFD 417 from the surrounding environment and may protect users from encountering high voltages within VFD enclosure 415. VFD enclosure 415 may, in some embodiments, be secured to VFD platform 403 by one or more vibration isolation mounts to, for example and without limitation, provide vibration and motion damping between VFD enclosure 415 and substructure assembly 101 during transportation of integrated fracking system 100. Such damping may, without being bound to theory, mitigate the risk of damaging VFD 417 as well as causing damage to substructure assembly 101 due to movement or torsional loading caused by VFD 417 during travel over uneven terrain.

VFD 417 may provide power to motors 203*a*, 203*b* and may control the operation of motors 203*a*, 203*b* by, for example and without limitation, controlling the speed and torque of motors 203*a*, 203*b* and thereby the pump rate of frac pumps 201*a* or 201*b* by varying the voltage and current supplied to the respective motor 203*a*, 203*b* and by varying the frequency of the power supplied to motor 203*a*, 203*b*.

VFD 417 may, in some embodiments, be controlled by an operator positioned on VFD platform 403, may be controlled remotely, or may operate at least partially autonomously in response to predetermined operating parameters. In some embodiments in which VFD 417 is controlled remotely, VFD 417 may be controlled by a central control system used to manage multiple integrated fracking systems 100 positioned in a wellsite. In some embodiments, VFD subsystem 400 may include a radiator and fan assembly for thermal management of VFD 417.

In some embodiments, VFD subsystem 400 may include a unit control system, which may be accessible from VFD platform 403 of VFD subsystem 400. In some embodiments, an operator may control one or more aspects of the operation of integrated fracking system 100 through the unit control system. In some embodiments, for example and without limitation, the unit control system may be operatively coupled to other subsystems of integrated fracking system 100 through one or more communication cables.

In some embodiments, integrated fracking system 100 may include transformer subsystem 500. Transformer subsystem 500 may include transformer enclosure 501. Transformer enclosure 501 may house transformer 503, may protect transformer 503 from the surrounding environment, and may protect users from the high voltages found within transformer enclosure 501 during operation of transformer 503.

In some embodiments, transformer subsystem 500 may include transformer base 505. Transformer base 505 may support transformer enclosure 501 and transformer 503. Transformer base 505 may be coupled to frame rails 103 of substructure assembly 101. In some embodiments, transformer base 505 may be coupled to substructure assembly 101 via isolation mounts. Isolation mounts may, for example, provide vibration and motion damping between transformer subsystem 500 and substructure assembly 101 during transportation of integrated fracking system 100. Such damping may, without being bound to theory, mitigate the risk of damaging transformer 503 as well as causing damage to substructure assembly 101 due to movement or torsional loading caused by transformer subsystem 500 during travel over uneven terrain. In some embodiments, damping may further reduce transmission of vibrations caused by transformer 503 to the rest of integrated fracking system 100 during operation of transformer 503.

The foregoing outlines features of several embodiments so that a person of ordinary skill in the art may better understand the aspects of the present disclosure. Such features may be replaced by any one of numerous equivalent alternatives, only some of which are disclosed herein. One of ordinary skill in the art should appreciate that they may readily use the present disclosure as a basis for designing or modifying other processes and structures for carrying out the same purposes and/or achieving the same advantages of the embodiments introduced herein. One of ordinary skill in the art should also realize that such equivalent constructions do not depart from the spirit and scope of the present disclosure and that they may make various changes, substitutions, and alterations herein without departing from the spirit and scope of the present disclosure.

The invention claimed is:

1. An integrated fracking system comprising:

a substructure assembly including one or more frame rails, the substructure assembly having a front end and a rear end;

a pump subsystem including a first frac pump, a first motor operatively coupled to the first frac pump, a second frac pump, and a second motor operatively coupled to the second frac pump, the pump subsystem coupled to at least one frame rail;

a variable frequency drive (VFD) coupled to at least one frame rail; and a transformer coupled to at least one frame rail;

wherein the substructure assembly includes a cable tray coupled to at least one frame rail, the cable tray positioned between the frame rails and extending from the front end of the substructure to the rear end of the substructure.

2. The integrated fracking system of claim 1, wherein the first frac pump and first motor are offset laterally from a centerline of the substructure assembly in a first direction.

3. The integrated fracking system of claim 2, wherein the first motor is at least partially longitudinally aligned with the second frac pump.

4. The integrated fracking system of claim 3, wherein the fracking system has a longitudinal axis, wherein the longitudinal axis defines a forward direction and a rearward direction and wherein the first frac pump is positioned forward of the first motor and the second motor is positioned forward of the second frac pump.

5. The integrated fracking system of claim 4, wherein the first motor is positioned at least partially abeam of the second motor.

6. The integrated fracking system of claim 4, wherein the first frac pump is operatively coupled to the first motor by a first shaft assembly and the second frac pump is operatively coupled to the second motor by a second shaft assembly, wherein the first and second shaft assemblies are narrower than the first and second frac pumps and the first and second motors.

7. The integrated fracking system of claim 6, wherein the first shaft assembly is aligned with the second motor and the second shaft assembly is aligned with the first motor.

8. The integrated fracking system of claim 1, wherein the substructure assembly is part of a truck, trailer, or skid.

9. The integrated fracking system of claim 1, wherein the substructure assembly comprises wheels.

10. The integrated fracking system of claim 1, wherein the substructure assembly further comprises a coupler, the coupler adapted to couple the substructure assembly to a truck.

11. The integrated fracking system of claim 1, wherein the substructure assembly further comprises a leveling system, the leveling system including at least one leg, the leg being extendable and retractable such that substructure assembly may be leveled.

12. The integrated fracking system of claim 1, further comprising a slide-out platform subsystem, the slide-out platform subsystem including a movable platform, the movable platform slidingly coupled to the frame rails by one or more slide rails.

13. The integrated fracking system of claim 12, wherein the movable platform is movable between a retracted position and an extended position by an actuator.

14. The integrated fracking system of claim 12, wherein the movable platform includes one or more safety railings.

15. The integrated fracking system of claim 12, wherein the movable platform includes a ladder assembly, the ladder assembly comprising a ladder and handrails, the handrails rigidly coupled to a floor of the movable platform, the ladder movable between a lowered position and a raised position.

16. The integrated fracking system of claim 12, wherein the movable platform is positioned adjacent to the first frac pump and the first motor.

17. The integrated fracking system of claim 1, wherein the VFD is coupled to the frame rails through a VFD platform.

18. The integrated fracking system of claim 1, wherein the VFD is positioned within a VFD enclosure.

19. The integrated fracking system of claim 1, wherein the transformer is positioned within a transformer enclosure.

20. The integrated fracking system of claim 1, wherein the cable tray extends along a length of the substructure assembly.

21. The integrated fracking system of claim 20 wherein the cable tray houses at least one power cable that is operatively coupled to a component of the pump subsystem and wherein the cable remains operatively coupled to a component of the pump subsystem during transportation, whereby the need to reconnect each cable or line is reduced.

22. The integrated fracking system of claim 1 wherein the first and second frac pumps and first and second motors are coupled to a frac pump skid, and wherein the frac pump skid is selectively decoupleable from the substructure assembly such that the first and second frac pumps and the first and second motors may be assembled apart from substructure assembly.

* * * * *